United States Patent [19]

Keeling, Jr.

[11] 4,158,294

[45] Jun. 19, 1979

[54] REFRIGERATOR HAVING CABINET WARMING HEAT TRANSFER DEVICE

[75] Inventor: K. Bailey Keeling, Jr., Louisville, Ky.

[73] Assignee: General Electric Company, Louisville, Ky.

[21] Appl. No.: 856,374

[22] Filed: Dec. 1, 1977

[51] Int. Cl.[2] ..... F25B 47/00

[52] U.S. Cl. ..... 62/277; 62/89

[58] Field of Search ..... 62/89, 273, 277, 333, 62/441, 285, 456

[56] References Cited

U.S. PATENT DOCUMENTS

| | | | |
|---|---|---|---|
| 2,141,918 | 12/1938 | Knight | 62/277 |
| 2,444,667 | 7/1948 | Philipp | 62/277 |
| 2,537,314 | 1/1951 | Mortensen | 62/277 |
| 2,651,187 | 9/1953 | Harris et al. | 62/277 |
| 4,009,586 | 3/1977 | Skvarenina | 62/89 |

*Primary Examiner*—Lloyd L. King

*Attorney, Agent, or Firm*—Frederick P. Weidner; Radford M. Reams

[57] ABSTRACT

An anti-sweat refrigerator cabinet warming device including a secondary refrigerant loop heat transfer arrangement extending through the refrigerator cabinet to warm those portions which have a tendency to form condensate on the exterior surfaces. The secondary loop is warmed by thermal contact with the condenser loop of the refrigeration system, which thermal contact is selectively controllable by positioning of a control member to position a section of the secondary loop and the condenser loop into and out of thermal contact. This is accomplished by a clamp acting on the loop sections, operated by a manual control lever to allow the selective operation of the heat transfer device. This allows power conservation when the warming of the cabinet is not required to prevent condensate formation. The clamping device is designed to maximize the transfer of heat from the condenser loop section into the secondary loop section when the cabinet is being warmed.

14 Claims, 3 Drawing Figures

Fig-1
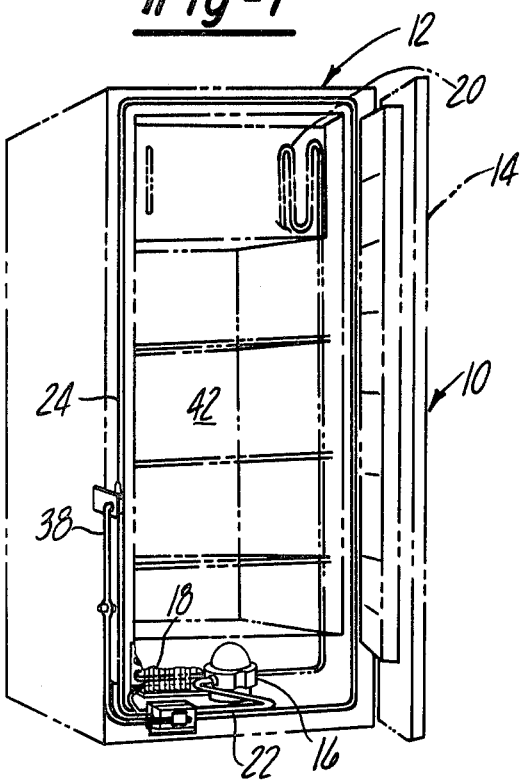
Fig-3
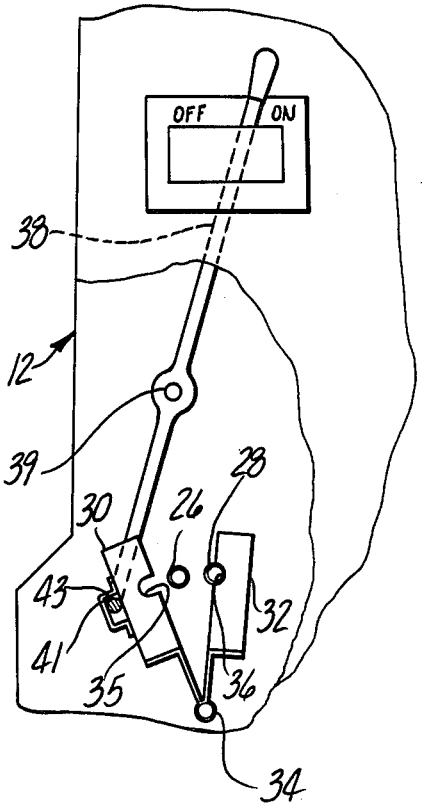
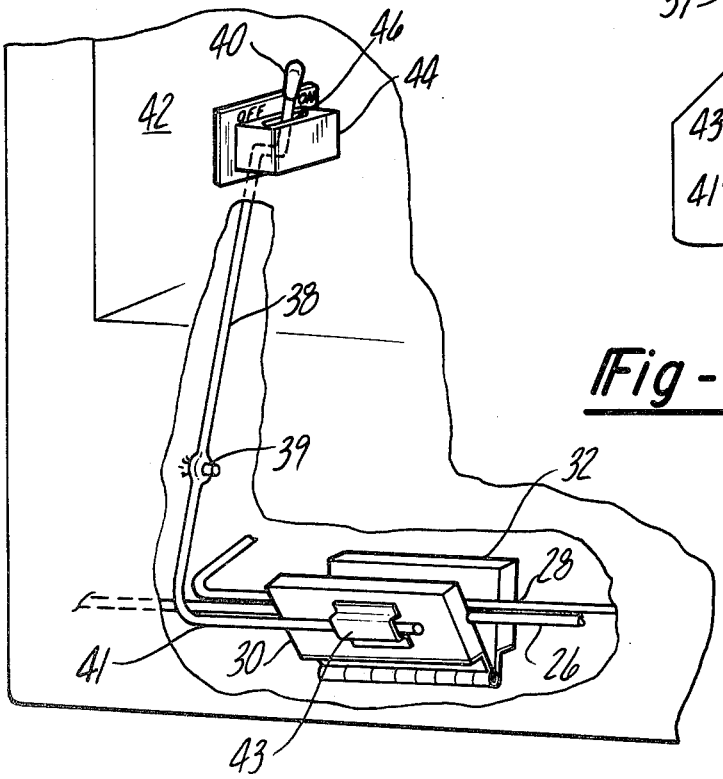
Fig-2

REFRIGERATOR HAVING CABINET WARMING HEAT TRANSFER DEVICE

BACKGROUND DISCUSSION

Many refrigerator cabinet designs cause certain surface regions of the cabinet to exhibit a tendency to be chilled below the dew point of the ambient air, such that condensate or "sweat" forms on these surfaces. One such region is located about the door sealing gasket. This condensate is unsightly and may have a deleterious effect on surface finish and wet the floor areas below these regions and, accordingly, it is sought to be avoided in most refrigerator designs.

If these regions are heated so as to be warmed above the dew point temperature of the ambient air, the formation of such condensate is avoided.

One approach which is currently widely practiced is the use of electric heating cables disposed within the refrigerator cabinet panels which are turned on and off as needed to prevent the condensate formation. While this is relatively simple to incorporate and readily controllable by a manual control switch, electric heating is relatively inefficient and increases the power required to operate the appliance.

The refrigerator system includes structure which is at a relatively elevated temperature, i.e., the compressor and the condenser coil. This relatively warm structure thus represents a possible heat source whenever the compressor is running which does not require an extra energy source. Rather, heat may be utilized which is otherwise merely dissipated into the surrounding room air.

Accordingly, it has heretofore been proposed to utilize a heat transfer system for utilizing this heat source to heat those regions of the refrigerator cabinet which are subject to the formation of condensate. Several examples of such systems are found in U.S. Pat. Nos. 2,141,918; 2,444,667; 2,537,314; and 2,651,187.

These systems typically incorporate a so-called "secondary loop" refrigerant circulation system in which a loop of tubing containing fluid material which can act as a refrigerant is placed in contact with relatively warm portions of the refrigerator structure such as the compressor housing or the condenser loop.

The relatively warm temperature heats the refrigerant within the secondary loop causing it to be vaporized and passed into the upper regions of the loop, which are located at the cabinetry regions to be warmed.

The resultant cooling of the heated refrigerant causes the refrigerant to condense releasing heat to warm the cabinet, the liquid refrigerant flowing back to the warm region in liquid form. Repetition of the cycle allows a relatively effective heat transfer means for utilizing the heat source provided by the warm or hot components of the refrigeration equipment and accordingly does not require any additional power in order to generate the anti-sweat heat.

The warming of the cabinet regions of course represents a thermal load on the refrigeration system. That is, the heat conducted into the interior space of the refrigerator is increased since the secondary loop is often located at regions where insulation is at a minimum causing the refrigeration equipment to be operated longer in order to maintain the refrigerated space at the desired temperature. Thus, this system does inherently create an energy loss which is required in the power to operate the appliance, and if this approach is taken to avoid exterior condensate, some inefficiency is unavoidable.

However, at times, the use of such an anti-sweat system is not required since the dew point of the ambient air may be sufficiently low that the existing temperature of the exterior surfaces will not result in the formation of condensate. This may occur at certain times of the year in certain locales, i.e., during the winter heating season, the extremely dry air within the building will reduce the dew point to the point where cabinet warming is not required. Similarly, in desert climes, the system may never be necessary. While such appliances are generally manufactured to a design adapted to all climates encountered within the market area, the unnecessary heat load could be avoided if the system were not operated.

Heretofore, such secondary loop systems have not been controllable and have been inherently permanently in operation by virtue of their design.

In U.S. Pat. No. 2,651,187, the system is mounted so as to heat the peripheral edges of the access door and in this patent, the heat transfer path is interrupted upon the door being opened. However, no separately operable control member is utilized which could be used to discontinue operation of the secondary loop when the need for cabinet warming is not required. The aforementioned electric cable heating systems generally provide a manually operable switch which allows selective operation of the cabinet heating to conserve power, but heretofore no heating system has been provided for secondary loop or heat transfer type cabinet warming devices.

The specific arrangement disclosed in the listed patents for heating the secondary loop is relatively cumbersome in that it requires relatively permanent affixation to the compressor motor, or portions of the refrigerator frame. This adds to the cost of manufacture.

It is accordingly an object of the present invention to provide a heat transfer cabinet warming device for refrigerator cabinetry in which the cabinet warming process is selectively controllable.

It is another object of the present invention to provide such a device in which a very simple arrangement for the transfer of heat from the heat source is manually controllable by a control member which is manipulated manually to interrupt the transfer of heat into the cabinet areas.

It is still another object of the present invention to provide an arrangement for producing heating of a secondary loop section by an easily installed arrangement and which allows thermal contact to be interrupted.

SUMMARY OF THE INVENTION

These and other objects of the present invention which will become apparent upon a reading of the following specification and claims, are accomplished by an arrangement wherein the transfer of heat from the heat source for the warming device is selectively controllable such as to interrupt the transfer of heat whenever the warming is not necessary. This selective interruption is carried out by means of a control member which is positionable in either a first position whereat there is established a conductive coupling of the heat transfer device to the heat source or in a second position whereat there is a conductive decoupling of the heat transfer device from the heat source. The heat transfer device may take the form of a secondary refrigerant loop in which a tubing circuit charged with refrigerant is utilized to act to transfer heat from the condenser coil section of the refrigeration system. The control is then accomplished by sections of the secondary loop tubing and the condenser tubing being brought into contact with each other by a clamping device actuated by a control lever in which a first position clamps together the tubing section to accomplish the conductive coupling and in the second position allows the tubing sections to move apart and release the clamping device to interrupt the conduction of heat to the cabinet. In one particular embodiment, the clamp includes clamping blocks, at least one of which is in contact with the condenser loop and is formed of a conductive material to act as a secondary heat source and to aid in the transfer of heat to the secondary loop when in contact with the condenser loop section.

DESCRIPTION OF THE DRAWINGS

FIG. 1 is a perspective view of a refrigerator showing in outline form the selectively interruptable cabinet warming device according to the present invention.

FIG. 2 is an enlarged fragmentary view of a portion of the refrigerator cabinetry shown in FIG. 1 showing the details of the warming device control arrangement.

FIG. 3 is a view of the warming device control components shown in FIG. 2 in an enlarged cross sectional view.

DETAILED DESCRIPTION

In the following detailed description, certain specific terminology will be utilized for the sake of clarity and a particular embodiment described in accordance with the requirements of 35 USC 112, but it is to be understood that the same is not intended to be limiting and should not be so construed inasmuch as the invention is capable of taking many forms and variations within the scope of the appended claims.

Referring to the drawings and particularly FIG. 1, the refrigerator 10 includes a refrigerator cabinet 12 defining an enclosed interior space and in which an access door 14 is provided in the conventional manner. A refrigeration system is included to cool the interior space which typically includes a compressor 16, a condenser coil 18 and an evaporator coil 20. This system operates in the conventional fashion to compress a refrigerant in the compressor, condensing the hot compressed refrigerant in the condenser coil 18 by radiating the excess heat and allowing the condensed refrigerant to vaporize in the evaporator coil 20 to thereby cool the interior space of the refrigerator.

The compression of the refrigerant in the compressor 16 increases the temperature of the refrigerant so as to become relatively warm or even hot such that the tubing 22 which carries the compressed refrigerant to the condenser tube comprises a relatively warm structure whenever the compressor is running. It is this portion of the refrigeration structure, according to the present invention, which is utilized as a heat source for obtaining heat to warm those portions of the refrigerator cabinetry which are subject to condensate formation.

The heat transfer device is of the type described in the aforementioned patent identified in the Background Discussion, i.e., comprised of a secondary refrigerant loop which serves to transfer heat into the refrigerator cabinet regions whereat the warming is to take place. The term "secondary loop" is utilized to distinguish the same from the refrigerant primary loop, i.e., the refrigeration components including the tubing loop utilized to circulate the refrigerant used to cool the interior space between the compressor, the condenser and the evaporator coils.

The secondary loop 24 is not in fluid communication with this loop, but rather is self-contained and includes a length of tubing which extends about the refrigerator cabinetry in locations whereat the warming is to be accomplished and also extends into the lower region of the cabinet to a point whereat a section of the secondary tubing passes adjacent to a section of the secondary refrigerant loop which contains a relatively hot compressed refrigerant intermediate the compressor 16 and condenser coil 18. The heat transfer device includes the secondary loop 24 which is charged with a refrigerant fluid such that upon being heated in low regions of the cabinet, the refrigerant turns to a gaseous or vapor stage and rises through the upper loop sections coming into contact with the relatively cool upper portions of the secondary tubing loop 24. This causes the refrigerant to condense releasing its latent heat of vaporization and causing the cabinetry portions adjacent thereto to be warmed. Upon condensation of the secondary refrigerant to its liquid state, the refrigerant flows downwardly into the lower regions of the secondary loop to thus provide a mechanism for transferring heat from the hot condenser loop to the selected portions of the refrigerator cabinetry.

According to the concept of the present invention, this arrangement is selectively interruptable by means of a control member which may be manually moved independently of the access door 14 and which serves to conductively couple and decouple a section 26 of the secondary loop 24 with a relatively warm structure utilized as a heat source, i.e., in this case a section 28 of the condenser loop tubing. The control member in a first position causes the tubing sections 26 and 28 to be conductively coupled to each other by being brought into contact with each other, and in a second position causes the tubing sections to be moved apart to thus be conductively decoupled from each other.

This arrangement is best seen in FIGS. 2 and 3 in which the adjacent sections of the condenser loop 28 and secondary loop 26, respectively, pass between a pair of clamping members comprised of clamping blocks 30, 32 which are pivotally mounted at one end at 34 so as to be relatively movable toward and away from each other. Clamping blocks 30, 32 act as clamping means for clamping the secondary section 26 and condenser tubing section 28 together or allowing them to move apart.

The tubing sections 26 and 28 are positioned so as to be biased apart by their mounting within the cabinetry 12 such that upon release of the clamping means, the tubing sections move apart.

Each of the clamping blocks 30 and 32 are formed with arcuate recesses 35 and 36, respectively, each receiving a respective tubing section 26 and 28 to accurately guide them into contact with each other in the conductively coupled position.

The clamping block 32 remains stationary as the clamping block 30 is pivoted and is constructed of a thermally conductive material so as to act as a secondary heat source. For this purpose, the condenser tubing loop 28 is normally positioned in contact with the clamping block 32 so as to continue to heat the clamping block 32 even when the clamping device is released. The secondary loop section 26 is thereby warmed by contact with the clamping block 32 as well as by the contact with the condenser tubing loop section 28 improving the response of the unit upon activation of the clamping device.

The movable clamping block 30 is likewise constructed of a thermally conductive material such as a metal to increase the conductive flow of heat into the secondary loop section 26, when the clamping device is activated.

The relatively movable clamping block 30 is positioned by means of a control member comprised of a control rod or lever 38 which is pivotally mounted at 39 at a point intermediate its length with an end portion 41 being bent and passing into a bracket 43 attached to the clamping block 30 such as to be drivingly connected thereto.

The upper end of the lever 38 extends upwardly within the interior of the refrigerator cabinet panel and has a terminal end 40 extending into the interior space 42 and offset as shown to be confined within a slotted bracket 44. The slotted portion 46 accommodates the pivotal movement of the upper portion of the control lever 38 and bears indicia indicating the "power saver" off and on positions of the control lever 38.

The control lever 38 is internally confined within the cabinet walls as indicated in FIG. 2 with the final terminal end 40 extending into the interior space 42 of the cabinet with a slotted opening provided to accommodate the movement of the end 40 of the control lever 38.

In the off position, the "power saver" feature is inactivated. That is, the cabinet warming is activated and the secondary loop section 26 and the condenser loop section 28 are moved into thermal contact, i.e., conductively coupled, by means of clamping block 30 being pivoted about the pivotal mount 34 to create the heat transfer from the condenser loop into the secondary refrigerant loop and the heating of the refrigerator cabinetry regions whereat the secondary loop is disposed.

In the "power saver" on condition, the secondary loop is conductively decoupled from the heat source by movement of the control lever 38 clockwise as viewed in FIG. 3 so as to pivot about pivot mount 39 and cause the clamping block 30 to be rotated away from the clamping block 32 allowing the secondary loop section 26 to move away from the condenser loop section 28 to thermally decouple the secondary loop from the condenser loop section 28 and the clamping blocks 30 and 32.

An arrangement has thus been provided for very simply and effectively allowing a selective control over the cabinet warming with a secondary refrigerant loop system. This is accomplished with a simple but highly reliable structure which should not add significantly to the cost of the appliance and enable realization of the power saving and overall efficiency improvement of the refrigerator in those situations in which the cabinet warming feature is not necessary.

Many variations of this concept are of course possible, such as the use of other portions of the refrigerator as a heat source, i.e., structural members heated by proximity to the compressor, condenser. Alternate arrangements for interrupting the transfer of heat from the heat source and the heat transfer device are also possible.

The embodiments of this invention in which an exclusive property or privilege is claimed are defined as follows:

1. In a refrigerator comprised of a refrigerator cabinet defining an enclosed space, a door providing access to said interior space and means for refrigerating said enclosed space, the combination including:

a heat source;

heat transfer means transferring heat from said heat source to portions of said refrigerator cabinet;

selectively operable control means interrupting said transfer of heat from said heat source to said refrigerator cabinet portions by said heat transfer means, said control means including a movable control member and means mounting said control member to be manually moved to differing positions independently of the position of said refrigerator door, said control means including means establishing said transfer of heat upon movement of said control member to one position, and also including means causing said interruption of said transfer of heat from said heat source in response to positioning of said control member in another position by said manual movement of said control member, whereby the heating of said portions of said refrigerator cabinet by said heat transfer means may be controlled by moving said control member independently of said door position.

2. The refrigerator according to claim 1 wherein said heat transfer means includes means conductively coupling said heat transfer means and said heat source and wherein said means causing said interruption of said heat transfer from said heat source comprises means for conductively decoupling said heat transfer means from said heat source in response to movement of said control member.

3. The refrigerator according to claim 2 wherein said heat transfer means includes a tube extending upwardly into said cabinet portions, said tube being charged with refrigerant fluid, and further includes means conductively coupling a lower section of said tube and said heat source, circulation of said refrigerant fluid in said tube by heating by said heat source and cooling by said cabinet portions causing said transfer of heat into said refrigerator cabinet portions.

4. The refrigerator according to claim 3 wherein said heat source comprises a relatively warm structure and wherein said heat transfer means includes means conductively coupling said relatively warm structure and said lower section of said tube extending into said refrigerator cabinet portions.

5. The refrigerator according to claim 4 wherein said means conductively coupling said lower section of said tubing and said relatively warm structure comprises means for bringing said lower tube section and said relatively warm structure into thermal contact in said one position of said control member and wherein said means conductively decoupling said heat transfer means and said heat source comprises means moving said lower tube section and said relatively warm structure apart upon movement of said control member to said another position.

6. The refrigerator according to claim 5 wherein said means for moving said lower tube section and said relatively warm structure into and out of thermal contact comprises clamping means including a pair of clamping members relatively movable to clamp said lower tube section and said relatively warm structure together when said control member is in said one position whereat said conductive coupling is established and further including means moving said clamping members apart upon movement of said control member to said another position wherein said conductive decoupling occurs.

7. The refrigerator according to claim 6 wherein said clamping means comprises a pair of clamping members pivotally mounted with respect to each other allowing pivoting movement of said clamping members toward and away from each other and whereat said lower tube section passes inbetween said clamping members, said relatively warm structure is positioned between said clamping members, whereby said clamping members rotating into engagement with said lower tube portion and said relatively warm structure causes said thermal contact therebetween to conductively couple said lower tube section and said relatively warm structure upon movement of said control member to said one position.

8. The refrigerator according to claim 7 wherein said control member comprises a pivotally mounted lever and wherein said lever is drivingly connected to said clamping means to cause said clamping members to be pivoted together in said one position of said control member on said pivotal mount and wherein said clamping members are pivoted apart upon movement of said lever to said another position about said pivotal mount.

9. The refrigerator according to claim 7 wherein one of said clamping members is formed with a recessed area adapted to receive said lower tube section and wherein said clamping members are constructed of a thermally conductive material.

10. The refrigerator according to claim 9 wherein said clamping means includes means positioning the other of said clamping members in thermal contact with said relatively warm structure in both said one and another positions of said control member, whereby said other clamping member is heated thereby in both positions of said control member.

11. The refrigerator according to claim 10 wherein said means for refrigerating said space comprises a compressor, condenser and evaporator coil system comprised of a compressor for compressing a refrigerant, condenser means receiving said compressed fluid refrigerant including a condenser coil, refrigerant tubing extending from said compressor to said condenser coil, and also including an evaporator coil in said enclosed space receiving refrigerant from said condenser coils, whereby said refrigerant in said tubing extending from said compressor to said condenser coils produces a relatively warm structure whenever said compressor is in operation, and wherein said relatively warm structure comprises a section of said tubing interposed between said compressor and said condenser coils.

12. The refrigerator according to claim 3 wherein said means for refrigerating said space comprises a compressor, condenser and evaporator coil system comprised of a compressor, for compressing a refrigerant, condenser means receiving said compressed fluid refrigerant including a condenser coil, refrigerant tubing extending from said compressor to said condenser coil, and also including an evaporator coil in said enclosed space receiving refrigerant from said condenser coils, whereby said refrigerant in said tubing extending from said compressor to said condenser coils produces a relatively warm structure whenever said compressor is in operation, and wherein said relatively warm structure comprises a section of said tubing interposed between said compressor and said condenser coils.

13. The refrigerator according to claim 7 wherein said lower tube section is adjacent said section of said tube extending between said compressor and said condenser coil, said adjacent tubing sections extending between said clamping members.

14. The refrigerator according to claim 9 wherein said another of said clamping members is formed with a recess receiving said section of tubing extending from said compressor to said condenser.

* * * * *